United States Patent [19]

Gendelman et al.

[11] Patent Number: 4,694,867

[45] Date of Patent: Sep. 22, 1987

[54] LOOM REED

[75] Inventors: Mikhail A. Gendelman; Anatoly F. Borodulin; Diana F. Golubeva; Sergei V. Bychkov, all of Klimovsk Moskovskoi, U.S.S.R.

[73] Assignee: Klimovskoe Spetsialnoe Konstruktorskoe Bjuro Po Proektirovaniju Tkatskogo Oborudovania, Klimovsk, U.S.S.R.

[21] Appl. No.: 916,224

[22] Filed: Oct. 7, 1986

[30] Foreign Application Priority Data

Oct. 8, 1985 [SU] U.S.S.R. ..... 3975056

[51] Int. Cl.[4] ..... D03D 49/62

[52] U.S. Cl. ..... 139/192; 139/438

[58] Field of Search ..... 139/188 R, 192, 438, 139/439

[56] References Cited

U.S. PATENT DOCUMENTS

| | | | |
|---|---|---|---|
| 2,714,403 | 8/1955 | Turner | 139/439 |
| 3,809,130 | 5/1974 | Strauss et al. | 139/192 |
| 4,458,730 | 7/1984 | Benelli | 139/192 |

*Primary Examiner*—Henry S. Jaudon

*Attorney, Agent, or Firm*—Fleit, Jacobson, Cohn & Price

[57] ABSTRACT

The reed is intended for looms having a guiding channel for a weft thread inserter and includes a plurality of plates interconnected at their bottom parts and each having a recess. The recesses of the plates jointly define the open guiding channel for a moving weft inserter and for leading out the weft or filling thread. At their portions outside the shed the plates have projections or lugs extending toward the adjacent plates and spaced therefrom. This provides for keeping stable the dimensions of the guiding channel as the weft inserter moves therealong, and also facilitates threading of the warp through the reed.

4 Claims, 4 Drawing Figures

LOOM REED

FIELD OF THE INVENTION

The present invention relates to looms, and more particularly it relates to a loom reed. The invention can be used to the utmost effectiveness in looms having a guiding channel in the reed for the moving weft inserter.

DESCRIPTION OF THE PRIOR ART

There are widely known looms with a reed taking part in the beating up of the weft or filling, and a separately provided guiding channel for a moving weft inserter, arranged parallel with the reed.

With the reed and the guiding channel having been separated, the swinging angle of the slay has to be increased, to provide for leading out the channel outside the shed. This affects the operating speed of the loom.

There is further known a reed that performs simultaneously the functions of taking part in the beating up of the weft or filling, and of guiding the weft inserter. This reed comprises a plurality of plates interconnected at their bottom and top parts, each plate having a partly circular recess. These recesses of the plates jointly define an open guiding channel for the moving weft inserter and for leading out the weft thread or filling (see, for example, U.S. Pat. No. 3,831,640; Cl. 139-125, dated 1974).

However, the securing of the plates of the reed at their upper parts creates difficulties in threading the warp through the reed necessitating the use of special-design hooks, and involves additional time expenditure on eliminating warp breakages. Furthermore, the known reed requires additional efforts and labor input in its manufacture, as its assembly requires that the plates be aligned at three areas, viz. the upper and bottom openings for the rods, and the recesses defining the guiding channel.

OBJECTS AND SUMMARY OF THE INVENTION

It is an object of the present invention to create create a reed for a loom, which should facilitate the threading of warp threads through the reed.

It is another object of the present invention to provide for maintaining stable dimensions of the guiding channel for unobstructed passage of a weft inserter.

These and other objects are attained in a reed for a loom, comprising a plurality of plates interconnected at the bottom parts thereof and having each a recess, the recesses of the plates jointly defining an open guiding channel for the motion of a weft inserter through the shed of the loom and for leading out the weft thread, in which reed, in accordance with the present invention, at least some of the plates on their portions situated above and below the shed area of the loom are provided with projections facing the adjacent plates and having a thickness smaller than the spacing between the plates.

In a preferred embodiment of the invention, plates having no projections are interposed between plates provided with projections.

It is expedient that the projections of the plates, situated under the shed area, be of a greater thickness than the projections situated above the shed area. The projections may be defined by curves in the plates.

With the reed being assembled of plated interconnected exclusively at the bottom parts thereof, a warp thread can be easily and swiftly guided through the reed. The provision of the projections or lugs on the plates confines as above described limits the deflection of the plates as the weft inserter moves along the guiding channel, providing a stability of the dimensions of the channel and thus precluding jamming of the weft inserter.

SUMMARY OF THE DRAWINGS

The invention will be further described in connection with an embodiment of the present invention in a loom reed, with reference being made to the accompanying drawings, wherein.

The invention will be further described in connection with its embodiment in a loom reed, with reference being made to the accompanying drawings.

Figure 1:
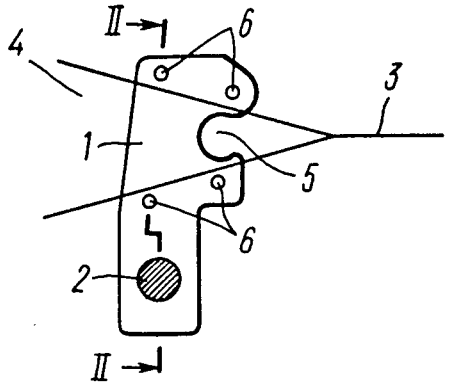
FIG. 1 is a side elevation of the reed embodying the invention.

The reed for a loom comprises a plurality of parallel plates 1 (FIG. 1) arranged in a row. The plates 1 are interconnected at their bottom parts with the aid of a rod 2 extending through aligned openings provided for this purposed in each plate 1. The reed is mounted in the slay beam (not shown in the drawings, FIGS. 1 to 4) of the loom. Warp threads 3 extend intermediate the successive plates 1, defining a shed area 4 (FIG. 1). Each plate 1 is provided with a recess 5, the recesses 5 of all the plates 1 being aligned to define jointly an open guiding channel for the motion of a weft inserter (not shown, either), and for leading out a weft thread (not shown).

The plates 1 are provided with projections or lugs, 6′ extending toward adjacent plates 1 and situated outside the shed area 4 of the loom, the projections being provided on upper and lower portions of each plate 1, respectively, overlying and underlying the recess 5.

Figure 2:
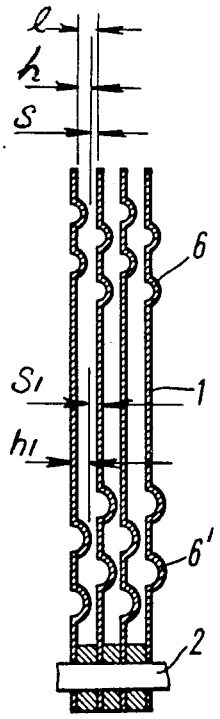
FIG. 2 is an enlarged sectional view taken on line II—II of FIG. 1.
Figure 3:
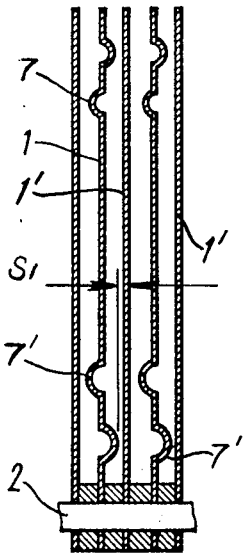
FIG. 3 shows the same, as FIG. 2, with a modified design of the plates of the reed.
Figure 4:
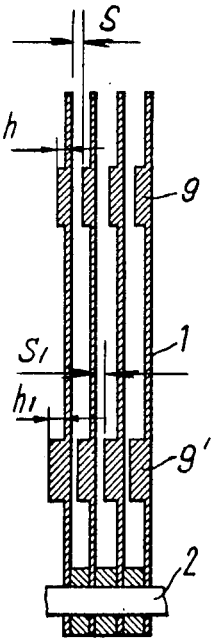
FIG. 4 shows the same, as FIG. 2, with modified projections on the plates.

The projections 6, 6′ on each plate 1 are arranged so as to face a flat portion of the adjacent plate 1, as it can be seen in FIGS. 2 to 4. When projections are provided on each successive plate 1, they should be relatively staggered, as it can be seen in FIG. 2. The thickness of all the projections is smaller than the spacing l between adjacent plates. The projections 6, 6′ on the plates 1, however, which are situated under the shed area 4, have a greater thickness or lateral dimension h′ than the thickness or lateral dimension h of the projections 6 situated above the shed 4. Accordingly, gaps $S_1$ are smaller than gaps S.

In one embodiment of the invention, as shown in FIG. 3, projections 7, 7′ are provided not on each successive plate 1, but on alternating plates 1. In this embodiment plates 1′ devoid of projections are interposed between the plates 1 with the projections, the latter being provided at both sides of the plates 1.

Whatever the embodiment, the projections on the plates 1, as illustrated in FIGS. 2 to 4, are of such thickness or lateral dimensions "h" and "$h_1$" that in the assembled state of the reed they should be spaced from the adjacent plates 1, i.e. they should clear the adjacent plates by gaps S and $S_1$ respectively.

The projections on the plates 1 can be made in different ways, e.g. in the form of thickened portions or lugs 9, 9', as shown in FIG. 4, or by stamping or depressing in the appropriate manner the sheet material of the plate 1, as shown in FIGS. 2 and 3, to provide curves defining the projections, these depressions or stamped-out portions being either to one side of each plate 1, when every plate 1 has projections (FIG. 2), or to both sides of the plates, when the plates 1 with projections alternate with plates devoid of projections (FIG. 3).

When the projections 9, 9' are made in the way illustrated in FIG. 4, the task of the loom operator is additionally simplified when the operator has to cope with a group of broken warp threads. With the projections having the shape illustrated in FIG. 4, a successive warp thread is guided into the corresponding space between the plates and is caught temporarily in or below the gap S between the projection 9 and the adjacent plate 1, so that the operator is able to monitor visually the properness of the guiding of the warp threads. In this way the time spent on eliminating warp breakages is cut down.

OPERATION

The herein disclosed reed is operated, as follows.

As the weft inserter moves along the guiding channel jointly defined by the recesses 5 of the plates 1, the effort of the moving weft inserter tends to deflect the unattached top extremeties of the plates from their vertical position. However, this deflection of the plates is confined by the projections which, upon a plate having been deflected, abut against the next adjacent plate and would not let their own plate deflect by an extent which could cause the jamming of the weft inserter in the guiding channel, or result in a breakage of warp threads on account of their physical contact with the plates.

Thus, it can be seen that the present invention provides for maintaining a stability of the dimensions of the guiding channel, the presence of the gaps between the plates facilitating the guiding of warp threads through the reed without the use of special hooks.

We claim:

1. A reed for a loom comprising a plurality of plates each having a central portion to be accommodated in a shed area of the loom and having upper and lower portions to be situated above the shed area and below the shed area respectively, means interconnecting the lower portions of the plates to align the plates in a successive row, aligned recesses in the central portions of the respective plates to be accommodated in the shed area, said recesses jointly defining an open guiding channel for accommodating the motion of an inserter through the shed of the loom and for leading out a weft thread inserted by the inserter, and projections provided on said upper and lower portions of at least some of the plates, the projections facing adjacent ones of the plates and each having a thickness which is smaller than a space between the plates.

2. A reed as claimed in claim 1 wherein the projections on the lower portions of the plates have a greater thickness than the projections on the upper portions of the plates.

3. A reed as claimed in claim 1 wherein the projections are provided on alternative plates and plates between the alternative plates are free of projections.

4. A reed as defined in claim 1 wherein the projections are defined by curves in the plates.

* * * * *